US006069347A

United States Patent [19]

Genji et al.

[11] Patent Number: 6,069,347

[45] Date of Patent: May 30, 2000

[54] HEATING ROLLER DEVICE

[75] Inventors: Nobuo Genji, Osakasayama; Takahiro Miyauchi, Toyonaka; Hidekazu Yamashita, Osaka; Naoaki Ishimaru, Mino, all of Japan

[73] Assignee: Matsushita Electric Industrial Co., Ltd., Osaka, Japan

[21] Appl. No.: 09/010,348

[22] Filed: Jan. 21, 1998

[30] Foreign Application Priority Data

Jan. 22, 1997 [JP] Japan ..... 9-009326
Dec. 15, 1997 [JP] Japan ..... 9-344878

[51] Int. Cl.[7] ..... H05B 6/14

[52] U.S. Cl. ..... 219/619; 219/634; 219/670; 219/652; 399/330; 399/336

[58] Field of Search ..... 209/619, 634, 209/635, 670, 672, 652, 649; 399/328, 330, 335, 336, 333

[56] References Cited

U.S. PATENT DOCUMENTS 3,529,116 9/1970 Miyagi ..... 219/619
4,256,945 3/1981 Carter et al. ..... 219/634
5,053,595 10/1991 Derbyshire ..... 219/634
5,227,596 7/1993 McGaffigan et al. ..... 219/616
5,568,240 10/1996 Ohtsuka ..... 399/335

FOREIGN PATENT DOCUMENTS 7-114276 5/1995 Japan .

*Primary Examiner*—Philip H. Leung
*Attorney, Agent, or Firm*—Pearne, Gordon, McCoy & Granger LLP

[57] ABSTRACT

A heating roller device which incorporates a metal roller having a curier temperature adjusted to an appropriate level and enabling a self-temperature-controllability and which has a structure that the metal roller is induction-heated by an induction heating section. A method of manufacturing the foregoing metal roller according to the present invention has a step of joining a pipe, which is made of temperature-sensitive magnetic metal, and the composition of which has been adjusted so as to have a predetermined curier temperature, and metal having a resistivity lower than that of the temperature-sensitive magnetic metal to each other by a drawing work in such a manner as to prevent formation of any gap. Thus, an induction heating pipe exhibiting an excellent heating characteristic is manufactured.

14 Claims, 10 Drawing Sheets

HEATING ROLLER DEVICE

BACKGROUND OF THE INVENTION

1. Field of the Invention

The present invention relates to a heating roller device for use in a device for heating and fixing toner in a copying machine, a laser beam printer or the like, a device for laminating steel plates, a device for laminating plastic films or the like.

2. Description of the Related Art

A major portion of fixing portions of copying machines, such as the copying devices and laser beam printers, has a structure formed as shown in FIG. 16. Toner powder 2 is transferred to a sheet 1 made of paper or the like by dint of static electricity, and then the sheet 1 is allowed to pass through a position between a heating roller 3 and a pressing roller 4. As a result, toner powder transferred to the surface of the sheet 1 is heated, melted and pressed so as to be fixed to the surface of the sheet 1. The heating roller 3 has a heat source which is a halogen lamp heater 5 disposed in the central portion of the heating roller 3. A thermistor sensor 6 disposed to be in contact with the surface of the heating roller 3 detects the temperature of the surface of the heating roller 3. Thus, the output from the halogen lamp heater 5 is controlled in such a manner that the foregoing temperature is made to be a predetermined temperature level.

Hitherto, a method capable of joining the temperature sensitive metal and the aluminum plate to each other and arranged as shown in FIG. 17 has been suggested. That is, two plate-like members 23 and 24 are heated to about 400° C. in a heating furnace 25, and then allowed to pass through a position between rollers 26 to which a pressure is applied so as to be jointed to each other.

The heating roller devices typified by the above-mentioned copying device have a problem in that the temperature of the heating roller cannot easily be controlled. That is, the convenience of users has been satisfied by making the copying device to be adaptable to various sizes. The heating roller is arranged to be adaptable to, for example, A3-size so as to be capable of copying original documents having A5 to A3 sizes. If paper having the A5-size is copied, a structure, in which the temperature of a portion through which paper is allowed to pass is made to be constant, causes heat of the portions, through which paper is not allowed to pass, not to be deprived by paper. As a result, the temperature of the heating roller is raised excessively. Therefore, the temperatures of the heating roller can be uniformed only when a plurality of temperature sensors are attached and the heater serving as the heat source is sectioned so as to be individually controlled. If a unit for controlling the temperature suffers a breakdown, the temperature of the heating roller is raised excessively. Thus, there arise problems in that paper is burnt and a resin film is melted in a case where copying to the resin film is performed.

Moreover, a conventional method of joining the temperature-sensitive magnetic metal and the aluminum plate to each other suffers from a problem in that any pipe cannot be manufactured although a flat plate can be manufactured by joining. That is, if ends of the temperature-sensitive magnetic metal having a melting point of about 1200° C. are welded so as to be formed into a pipe, aluminum adjacent to the foregoing metal is undesirably melted. Aluminum has a melting point of about 600° C.

SUMMARY OF THE INVENTION

The present invention has been made to solve the above problems, and therefore an object of the invention is to provide a heating roller device which is capable of using the self-temperature-controllability of the metal roller and having a simple structure.

To achieve the above object, according to the invention, there is provided a heating roller device which incorporates a metal roller having a curier temperature adjusted to an appropriate level and enabling a self-temperature-controllability and which has a structure that the metal roller is induction-heated by an induction heating section.

A method of manufacturing the foregoing metal roller according to the present invention has a step of joining a pipe, which is made of temperature-sensitive magnetic metal, and the composition of which has been adjusted so as to have a predetermined curier temperature, and metal having a resistivity lower than that of the temperature-sensitive magnetic metal to each other by a drawing work in such a manner as to prevent formation of any gap. Thus, an induction heating pipe exhibiting an excellent heating characteristic is manufactured.

DETAILED DESCRIPTION OF THE PREFERRED EMBODIMENTS

Figure 1:
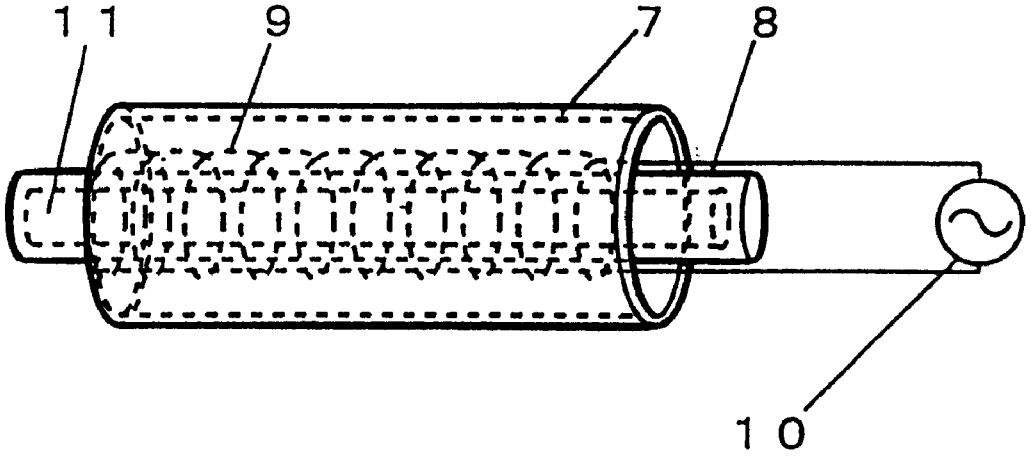
FIG. 1 is a perspective view showing the structure of a heating roller device according to a first embodiment of the present invention.

First of all, the basic structures of the present invention will be described.

A first aspect of the present invention has a structure that induction electric currents supplied from the induction heating section flow only on the surface because of the skin effect if the temperature of the metal roller is not higher than the curier temperature. Since the conductive cross sectional area is small in this case, the electric resistance is raised and thus the heating value is enlarged. If the metal roller is heated to a temperature higher than the curier temperature and thus the heating roller is brought to a non-magnetic state, induction electric currents flow in the overall body of the metal roller. Since the conductive cross sectional area is enlarged in this case, the electric resistance is lowered and thus the heating value is reduced. Therefore, the conductive cross sectional area must be different to correspond to the curier temperatures. Thus, the thickness of the metal roller is made to be larger than the skin depth.

A second aspect of the present invention has a structure that a metal roller is composed of an alloy, which has a curier temperature adjusted to an appropriate level, and a non-magnetic metal material laminated on the alloy. When the alloy has been brought to a non-magnetic state, induction electric currents flow in the non-magnetic metal material having resistance lower than that of the alloy. Thus, further apparent self-temperature-controllability can be realized.

A third aspect of the present invention has a structure that a non-magnetic metal material is disposed to have a space from an alloy. Thus, a heating roller device can be realized which has a small thermal capacity with which the heating roller device can be heated in a short time.

A fourth aspect of the present invention has the structure that an induction heating coil forming the induction heating section is disposed on the inside of the metal roller. Thus, a heating roller device is realized which enables magnetic shielding to easily be performed and which has furthermore improved self-temperature-controllability.

A fifth aspect of the present invention has the structure that an induction heating coil forming the induction heating section is disposed on the outside of the metal roller. Thus, a heating roller device can be realized, the temperature of which can quickly be raised.

A sixth aspect of the present invention has the structure that the induction heating coil forming the induction heating section is disposed at a position at which a target which must be heated and the metal roller are brought into contact with each other or a position immediately in front of the position of the contact. Thus, a heating roller device can be realized which does not require large electric power.

A seventh aspect of the present invention has the structure that the induction heating coil forming the induction heating section is disposed at a position at which a target which must be heated and the metal roller are separated from each other. Thus, a heating roller device can be realized which has a structure that a long time is required to make contact so that temperatures can be uniformed.

Eighth to eleventh aspects of the invention relate to methods of manufacturing the metal roller as set forth in the second aspect.

The eighth aspect of the present invention has the structure that a pipe, which is made of temperature-sensitive magnetic metal and the composition of which has been adjusted to have a predetermined curier temperature, and metal having a resistivity lower than that of the temperature-sensitive magnetic metal are joined to each other by a drawing work. Thus, an induction heating pipe can be realized which can be joined without any gap and which exhibits an excellent heating characteristic.

The ninth aspect of the present invention has the structure that a pipe made of metal having a low resistivity is, by press fitting, joined to the outside or inside of a pipe, the composition of which has been adjusted to have a predetermined curier temperature. Thus, the pipe made of temperature sensitive metal and a metal pipe made of copper and the pipe made of the temperature-sensitive magnetic metal, which have near melting points, can be joined to each other. Moreover, the length of the metal pipe can arbitrarily be determined.

The tenth aspect of the present invention has the structure that a pipe, which is made of temperature-sensitive magnetic metal and the composition of which has been adjusted to have a predetermined curier temperature, and a metal pipe having a low resistivity are joined to each other by brazing or soldering. Thus, low-volume manufacture can satisfactorily be performed. Moreover, manufacture can easily be performed when copper is employed to form the metal pipe.

The eleventh aspect of the present invention has the structure that a pipe made of temperature-sensitive magnetic metal is cast into metal having a low resistivity so as to be joined together. In this case, a complicated shape can easily be formed.

The twelfth aspect of the present invention has the structure that a temperature-sensitive magnetic metal pipe or a temperature-sensitive magnetic metal film, the composition of which has been adjusted to have a predetermined curier temperature, and a non-magnetic material having an electric resistivity lower than that of the temperature-sensitive magnetic metal are disposed in such a manner that a space is formed. In this case, significant self-temperature-controllability can be obtained, and the temperature can be raised in a short time because of a small thermal capacity.

The thirteenth aspect of the present invention has the structure that a heat insulation material is disposed in the space. In this case, the heat efficiency can be improved.

The fourteenth aspect of the present invention has the structure that an electrical insulation material is disposed on the surface of the induction heating coil so that the contact with the temperature-sensitive magnetic metal pipe or the temperature-sensitive magnetic metal film is prevented. Thus, the device can be protected from static electricity and lightning surge.

The fifteenth aspect of the present invention has the structure that the thickness of the temperature-sensitive magnetic metal pipe or the temperature-sensitive magnetic metal film is in a range from 50% to 200% of the skin depth in order to realize extreme self-temperature-controllability.

Now, a description will be given in more detail of preferred embodiments of the present invention with reference to the accompanying drawings.

First Embodiment

FIG. 1 is a perspective view showing the structure of a first embodiment of the present invention. A heating roller device according to this embodiment has a structure for use in a copying machine. A metal roller 7 is made of a magnetic alloy adjusted to have an appropriate curier temperature which is about 200° C. which is somewhat higher than a temperature at which toner is melted. In this embodiment the magnetic alloy is an alloy of iron and nickel or an alloy of iron, nickel and chrome. The foregoing combinations realize a high saturation magnetic flux density satisfactory for this embodiment. When the device is used to meet another purpose, the temperature required to be realized by the metal roller 7 is changed, as a matter of course. The composition of the alloy can be changed to obtain the required curier temperature.

The metal roller 7 is heated by an induction heating section for induction-heating the metal roller 7. The induction heating section comprises an induction heating coil 9 wound around a bobbin 8 disposed on the inside of the metal roller and a high-frequency power source 10 for supplying high frequency electric currents to the induction heating coil 9. In this embodiment, ferrite 11 is inserted into the core of the bobbin 8 in order to improve the heating efficiency. The induction heating coil 9 comprises a litz wire having a structure formed by binding a thin copper wire.

The operation of this embodiment will now be described. When a switch (not shown) is operated, the high-frequency power source 10 starts operating to supply high frequency electric current. A high frequency magnetic field corresponding to the high frequency electric current is generated by the induction heating coil 9. The high frequency magnetic field is interlinked to the metal roller 7 so that the metal roller 7 is induction-heated. The composition of the metal roller 7 has been adjusted to have an appropriate curier temperature. That is, electric currents which flow in the metal roller 7 are considerably different from each other between a period in which the temperature is lower than the curier temperature and a period in which the temperature has exceeded the curier temperature. That is, the metal roller 7 has a self-temperature-controllability.

Figure 2:
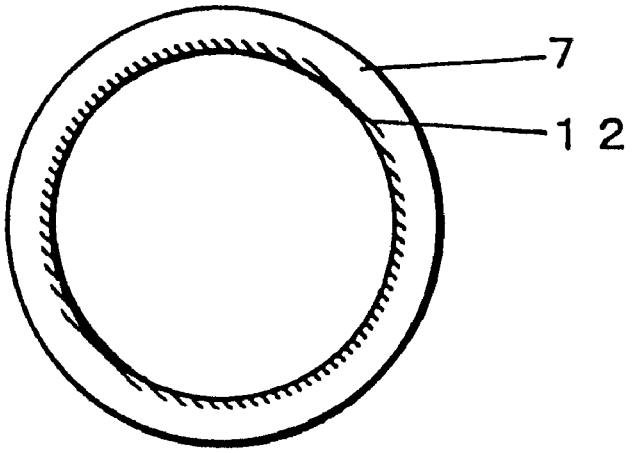
FIG. 2 is a diagram showing the operation of the heating roller device.
Figure 3:
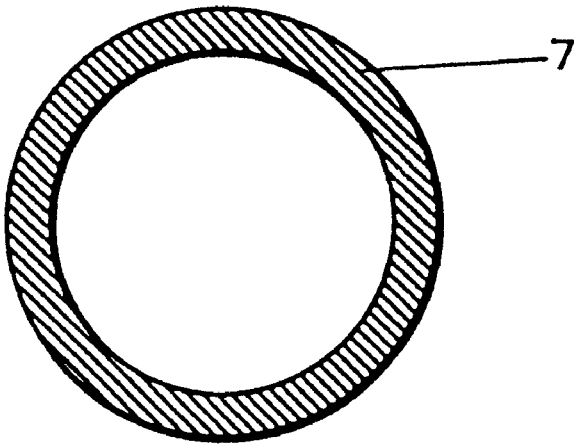
FIG. 3 is a diagram showing the operation of the heating roller device.

FIGS. 2 and 3 show the self-temperature-controllability. FIG. 2 shows the metal roller for giving an explanation of the skin effect. The induction electric current which flows in the metal roller 7 by dint of the high frequency magnetic field flows only on the surface of the metal roller attributable to the skin effect. In accordance with results of calculations, a range 12 in which induction electric currents flow is 0.4 mm from the surface if the frequency of the high frequency electric currents is 25 kHz. That is, the electric resistance is raised because the cross sectional area of a passage in which electric currents flow is small in the above-mentioned state. Thus, the heating value is enlarged. FIG. 3 shows a state of electric currents which flow in the metal roller 7 when the temperature has exceeded the curier temperature. If the temperature of the metal roller 7 is raised to a level not lower than the curier temperature, the metal roller 7 looses magnetism. Thus, the metal roller 7 is made to be a non-magnetic body. Therefore, induction electric currents which flow in the metal roller 7 attributable to the high frequency magnetic field flow in the overall cross section of the metal roller 7. That is, the cross sectional area of the passage in which electric currents flow is enlarged in this case, thus causing the electric resistance to be lowered. Thus, the heating value is reduced. In Japanese Patent Laid-Open No. 7-114276, a description has been given that self-temperature-control is enabled by using the curier temperature. If the thickness of the metal roller is the same or larger than the skin depth, the cross sectional area of the passage, in which induction electric currents flow, is not changed. Therefore, the electric resistance is not changed. In this case, the self-temperature-controllability cannot be realized. To use the self-temperature-controllability, the thickness of the metal roller must be larger than the skin depth.

When the heating roller device according to this embodiment is used as a copying machine, the temperature of the metal roller 7 is stabilized at a level near 200° C. if the curier temperature of the metal roller 7 is set to be about 200° C. which is somewhat higher than a temperature at which toner is melted. That is, even if the temperature exceeds 200° C. for some reason, the heating value of the metal roller 7 is reduced at the foregoing moment. If the temperature is lowered because, for example, paper having a width, with which the contact with only a portion of the metal roller is made, is allowed to pass through, the heating value of the portion, the temperature of which has been lowered, is enlarged.

Second Embodiment

Figure 4:
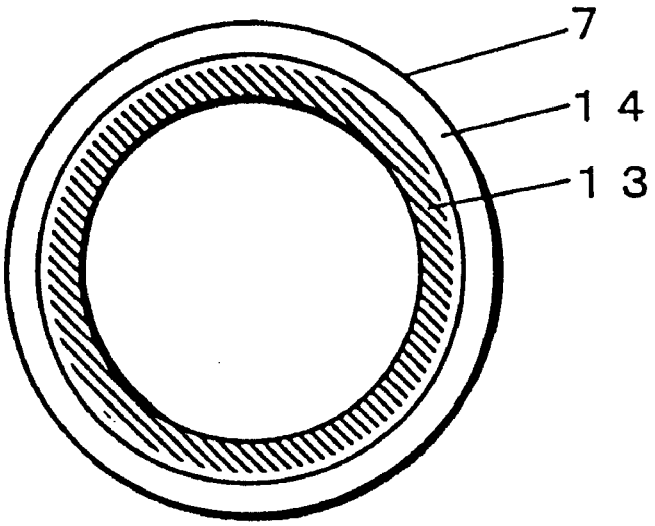
FIG. 4 is a diagram showing the structure and operation of a metal roller of a heating roller device according to a second embodiment of the present invention.
Figure 5:
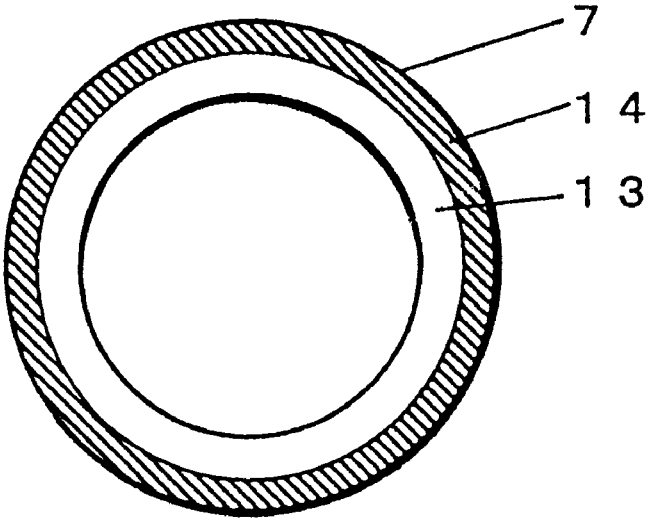
FIG. 5 is a diagram showing the structure and operation of the metal roller of the heating roller device according to a second embodiment of the present invention.

A second embodiment of the present invention will now be described. FIGS. 4 and 5 show the structure of a metal roller 7 for use in a heating roller device according to this embodiment. That is, the metal roller 7 comprises an alloy 13 having a curier temperature set to an appropriate level and a non-magnetic metal material 14 laminated on the alloy 13 and having a resistivity lower than that of the alloy 13. It is preferable that the non-magnetic metal material 14 is made of aluminum or copper.

As a result of the above-mentioned structure, the self-temperature-controllability of the metal roller 7 can furthermore be improved. Moreover, the shielding effect for reducing an influence of magnetic noise on the outside can be improved. That is, if the temperature of the alloy 13 is not higher than the curier temperature, induction electric currents flow only on the surface of because of the skin effect as shown in FIG. 4. If the temperature of the alloy 13 is raised to exceed the curier temperature and the alloy 13 is made to be a non-magnetic body, induction electric currents flow in the non-magnetic metal material 14 having a low resistivity. That is, the heating value of the alloy 13 is considerably reduced, thus causing the temperature to rapidly be lowered. That is, the structure according to this embodiment in which the induction heating coil 9 forming the induction heating section is disposed on the inside of the alloy 13 enables the self-temperature-controllability to be significantly be improved as compared with the structure according to the first embodiment. When the alloy 13 has been made to be a non-magnetic body, the magnetic flux passes through the alloy 13. However, the non-magnetic metal material 14 laminated around the alloy 13 and having a low resistivity reflects the magnetic energy and confined within the inside portion. That is, the non-magnetic metal material 14 serves as a shielding plate.

The most significant self-temperature-controllability can be exhibited when the thickness of the alloy 13 is substantially the same as the skin depth. If the thickness is smaller than the skin depth, a considerably large quantity of induction electric currents flows in the non-magnetic metal material 14 disposed on the outer side even in a case where the temperature is not higher than the curier temperature. If the thickness is larger than the skin depth, the quantity of induction electric currents which flow in the alloy 13 is enlarged even in a case where the temperature is not lower than the curier temperature. To shorten time required from start of supply of electric power to reaching a required temperature, that is, to shorten warm-up time, the thermal capacity of the metal roller is required to be reduced. Therefore, it is preferable that the thickness of the alloy 13 be in a range from 50% of the thickness of the skin determined to reduce the thermal capacity of the metal roller though the self-temperature-controllability is somewhat sacrificed to 200% of the thickness of the skin determined to strengthen the metal roller. If the self-temperature-controllability is given, use of the non-magnetic metal material 14 enables the thermal capacity to significantly be reduced as compared with the first embodiment.

As described above, the heating roller device according to this embodiment has sharp self-temperature-controllability. Even if the thermal loads become different depending upon positions because of use of paper sheets having a variety of sizes, only the portions, the temperatures of which have been lowered, can be heated. Thus, the temperatures can be uniformed. Another effect can be obtained in that a temperature sensor required for the heating roller device can be omitted. Thus, a heating roller device exhibiting a long lifetime can be obtained. In addition, even if the temperature control unit suffers a breakdown, the temperature does not exceed the curier temperature. Thus, a safety heating roller device can be realized. Since the non-magnetic metal material 14 is able to serve as the shielding plate, influence of magnetic noise on the outside can be reduced. Moreover, the thermal capacity of the metal roller can be reduced to shorten the warm-up time.

Third Embodiment

Figure 6:
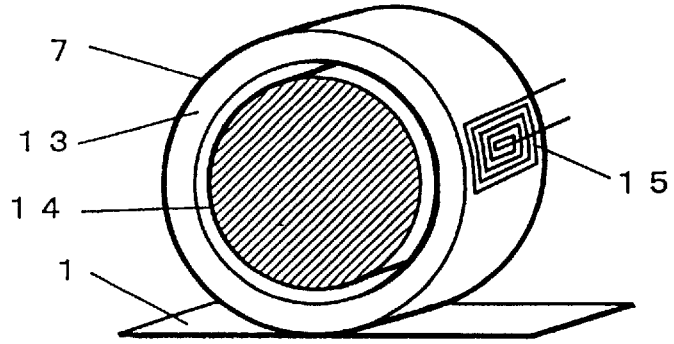
FIG. 6 is a perspective view showing the structure of a heating roller device according to a third embodiment of the present invention.

A third embodiment of the present invention will now be described. FIG. 6 shows the structure of a heating roller device according to this embodiment. That is, this embodiment has a structure that an induction heating coil 15 formed into a vortex is, by an appropriate method, disposed on the outside of an alloy 13 having an appropriate curier temperature in such a manner that the contact with an alloy 13 is prevented. A non-magnetic metal material 14 having a resistivity lower than that of the alloy 13 is disposed on the inside of the alloy 13 in such a manner that a space is formed from the alloy 13. Thus, the alloy 13 and the non-magnetic metal material 14 form the metal roller 7 similarly to the second embodiment.

As a result, the induction heating coil 15 heats only the alloy 13. Thus, a heating roller device exhibiting an excellent heat efficiency can be realized. Since this embodiment has a structure that the alloy 13 and the non-magnetic metal material 14 are disposed while a space is interposed, the induction heating coil 15 heats only the alloy 13. Thus, the target which must be heated has a very small thermal capacity as compared with a structure in which the overall body of the metal roller 7 must be heated. Even if the non-magnetic metal material 14 is not contact with the alloy 13, a magnetically similar operation can be performed. That is, if the temperature of the alloy 13 exceeds the curier temperature, the alloy 13 is made to be a non-magnetic body which causes magnetic flux to pass through the alloy 13. Thus, induction electric currents flow in the non-magnetic metal material 14 which is disposed on the inside of the device.

As described above, according to this embodiment, a heating roller device exhibiting an excellent heat efficiency can be realized because the induction heating coil 15 heats only the alloy 13. Therefore, time required to raise the temperature to a predetermined level can be shortened.

Fourth Embodiment

Figure 7:
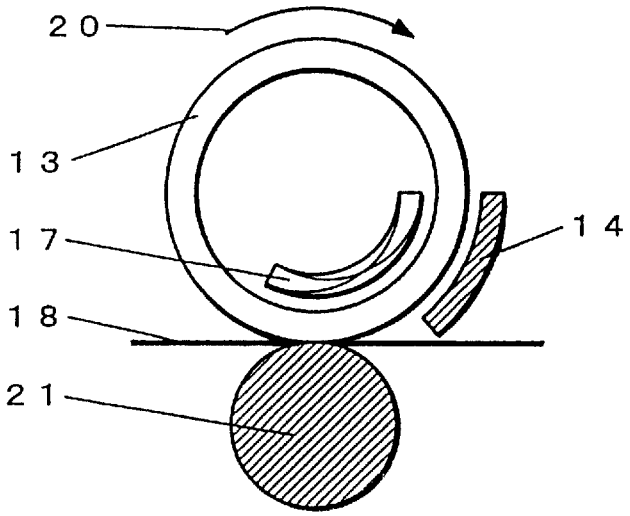
FIG. 7 is a perspective view showing the structure of a heating roller device according to a fourth embodiment of the present invention.

A fourth embodiment of the present invention will now be described. As shown in FIG. 7, this embodiment has a structure that the induction heating coil 17 is positioned at a position at which a target 18 which must be heated and an alloy 13 are brought into contact with each other or a position immediately in front of the position at which the alloy 13 is brought into contact with the target 18 which must be heated. In this embodiment, the non-magnetic metal material 14 is disposed to form a circular arc which opposes a portion of the alloy 13 while a space is interposed from the alloy 13. An arrow 20 shown in the drawing indicates a direction of rotation of the alloy 13. In addition, this embodiment has a structure that also a pressing roller 21 is made of a non-magnetic metal material having a low resistivity.

As a result of the above-mentioned structure, the induction heating coil 17 heats the position at which the alloy 13 is in contact with the target 18 which must be heated or the position immediately in front of the position at which the alloy 13 is brought into contact with the target 18 which must be heated. Then, the alloy 13 heated to a predetermined temperature immediately heats the target 18 which must be heated. As a result, time for which the alloy 13 has high temperatures is shortened, causing the quantity of heat radiation from the surface of the alloy 13 to be reduced. Thus, a heating roller device which does not consume a large quantity of electric power can be realized. Note that this embodiment has a structure that the non-magnetic metal material 14 disposed for the purpose of improving the self-temperature-controllability of the alloy 13 is formed into a circular arc. In addition, the effect of the non-magnetic metal material 14 is complemented by the pressing roller 21 made of the non-magnetic metal material.

Fifth Embodiment

Figure 8:
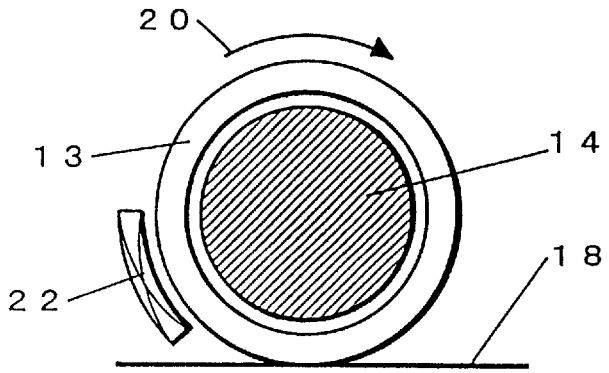
FIG. 8 is a perspective view showing the structure of a heating roller device according to a fifth embodiment of the present invention.

A fifth embodiment of the present invention will now be described with reference to FIG. 8. FIG. 8 is a cross sectional view showing the structure of this embodiment. This embodiment has a structure that an induction heating coil 22 is disposed at a position at which a target 18 which must be heated and an alloy 13 are separated from each other. Since the induction heating coil 22 is disposed at the foregoing position, the alloy 13 is rotated as indicated with an arrow 20. Thus, a long time is required for the alloy 13 to again come in contact with the target 18 which must be heated. As a result, the temperatures of the portion in which the alloy 13 is brought into contact with the target 18 which must be heated are lowered as compared with temperatures of the portion which is heated by the induction heating coil 22. However, the distribution of temperatures can be uniformed.

Sixth Embodiment

An embodiment of the alloy which has a curier temperature adjusted to an appropriate level, and a method of laminating the non-magnetic metal material on the foregoing alloy will now be described.

Figure 9:
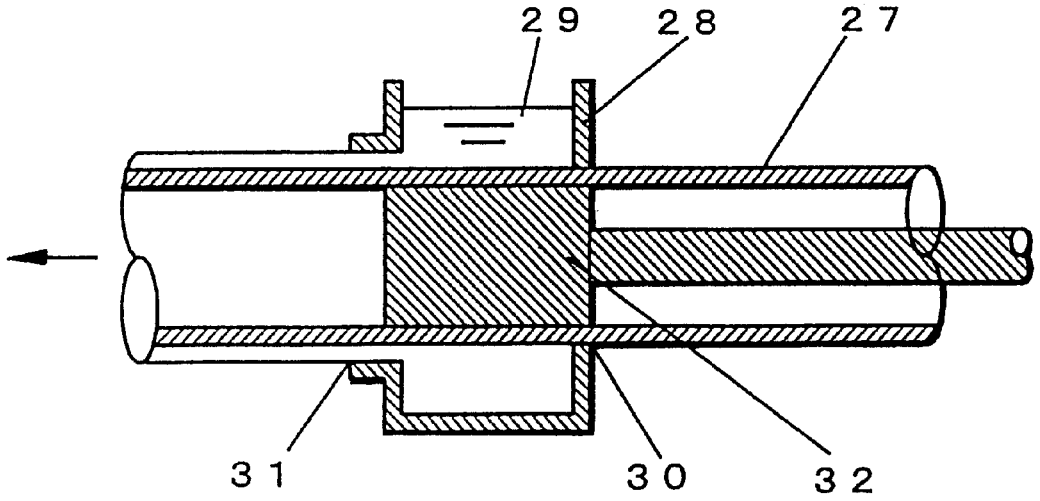
FIG. 9 is a diagram-showing the structure and a method of manufacturing an induction heating pipe according to an embodiment of the present invention.

FIG. 9 is a diagram showing a method of joining an aluminum pipe to the outer surface of a pipe 27 made of temperature-sensitive magnetic metal which is an iron-nickel alloy or an iron-nickel-chrome alloy. Aluminum 29 heated to a temperature not lower than the melting point and thus brought to a molten state is accommodated in a melting furnace 28. An opening 30 having a diameter corresponding to the outer diameter of the pipe 27 made of the temperature-sensitive magnetic metal is formed at either end of the melting furnace 28. On the other hand, an opening 31 having a diameter corresponding to the outer shape of the aluminum pipe is formed at another end of the melting furnace 28. A metal core 32 for preventing deformation of the temperature-sensitive magnetic metal pipe is disposed in the central portion of the melting furnace 28.

In the system structured as described above, the pipe 27 made of the temperature-sensitive magnetic metal is inserted into the opening 30, and then drawn through the opening 31 in a direction indicated by an arrow at predetermined speed. As a result, molten aluminum is allowed to adhere to the outer surface of the pipe 27 made of the temperature-sensitive magnetic metal. The thermal expansion coefficient of the pipe 27 made of the temperature-sensitive magnetic metal is $17\times10^{-6}$, while that of aluminum is $22\times10^{-6}$. Therefore, when the molded parts have been cooled, the aluminum pipe, from outside, tightens the pipe 27 made of the temperature-sensitive magnetic metal. Thus, the two elements can strongly be joined to each other. When a seamless pipe is employed as the pipe 27 made of the temperature-sensitive magnetic metal, deviation of the composition does not occur as compared with the welded pipe. Therefore, the curier temperature can satisfactorily be stabilized.

Seventh Embodiment

Figure 10:
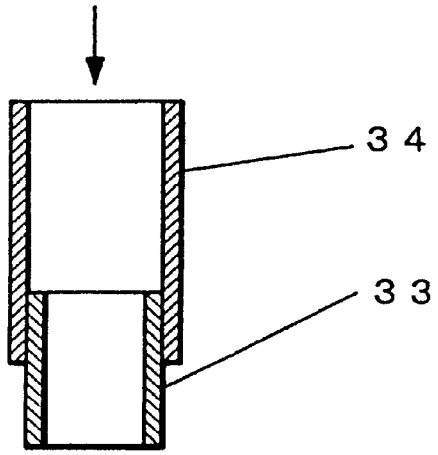
FIG. 10 is a diagram showing another structure and method of manufacturing the induction heating pipe.

The induction heating pipe can also be manufactured by a device structured as shown in FIG. 10. FIG. 10 shows a state in which a metal pipe 34 having a low resistivity is, by press fitting, joined to a pipe 33 made of the temperature-sensitive magnetic metal. When aluminum is employed as the metal having the low resistivity, this embodiment has a structure that the aluminum pipe is heated in an ambient having a temperature of 400° C. The thus-expanded aluminum pipe is press-fit into the pipe 33 made of the temperature-sensitive magnetic metal. When the temperature has been lowered to the ordinary temperature, the aluminum pipe tightens the metal pipe 34 made of the temperature-sensitive magnetic metal from outside. Thus, the two elements can strongly be joined to each other.

When the above-mentioned structure is employed, copper may be employed in place of aluminum to form the metal pipe having the low resistivity-and arranged to be joined to the outer surface of the pipe 33 made of the temperature-sensitive magnetic metal. Copper has a melting point considerably closing to that of stainless steel which forms the induction heating pipe 33. Therefore, the drawing method shown in FIG. 9 cannot be employed in the foregoing case. However, this embodiment enables copper to be used as the metal pipe having the low resistivity. In this case, the necessity that the length of the temperature-sensitive magnetic pipe and that of the metal pipe having the low resistivity are the same can be eliminated. Thus, the length can arbitrarily be determined.

Eighth Embodiment

Figure 11:
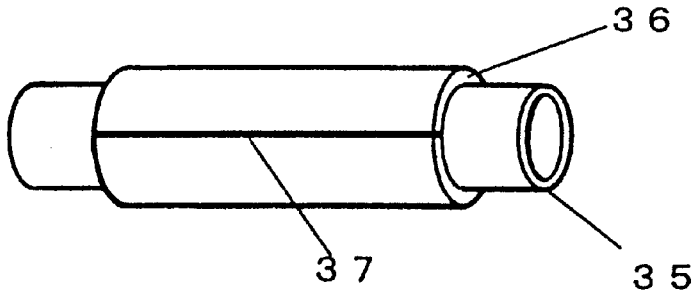
FIG. 11 is a diagram showing another structure and method of manufacturing the induction heating pipe.

As shown in FIG. 11, a copper plate 36 is wound around the temperature-sensitive magnetic metal pipe 35, and then soldered with solder 37 or brazed by using silver solder. The above-mentioned structure is suitable to a manufacturing method which is employed when copper is used to form the induction heating pipe. Since large-scale facilities are not required if the above-mentioned structure is employed, the foregoing structure is suitable when a small lot is manufactured.

Ninth Embodiment

Figure 12:
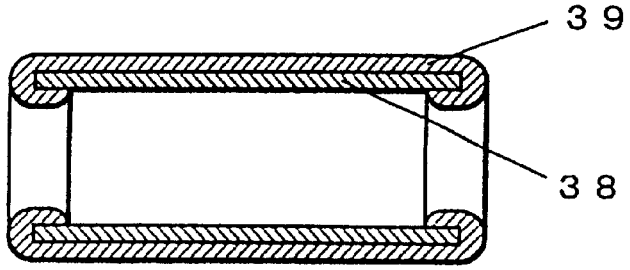
FIG. 12 is a diagram showing another structure and method of manufacturing the induction heating pipe.

As shown in FIG. 12, the temperature-sensitive magnetic metal pipe may be cast into the metal having the low resistivity so as to be joined together. Reference numeral 38 represents a temperature-sensitive magnetic metal pipe placed in a mold. Molten metal having the low resistivity, for example, aluminum is poured from an upper position. As indicated with reference numeral 39, the alloy surrounds the temperature-sensitive magnetic metal pipe 38 at ordinary temperature so that the induction heating pipe is molded. The above-mentioned structure enables the shape of the induction heating pipe, which must be manufactured, to arbitrarily be selected. Thus, the structure according to this embodiment is suitable to manufacture an induction heating pipe having a complicated shape.

Tenth Embodiment

Figure 13:
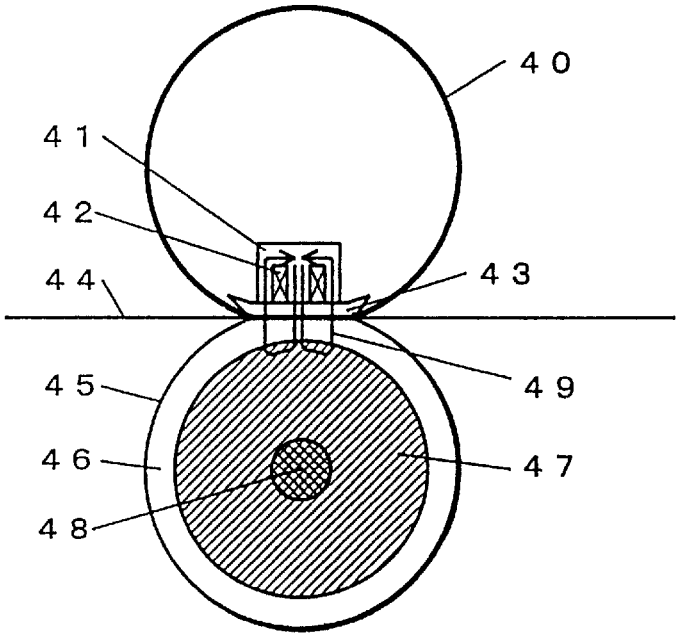
FIG. 13 is a cross sectional view showing a heating roller device according to a tenth embodiment of the present invention.

FIG. 13 is a cross sectional view showing a heating roller device according to a tenth embodiment and structured in such a manner that a temperature-sensitive magnetic metal film is induction-heated. Then, induction electric currents, which have been generated attributable to magnetic fluxes allowed to pass through the temperature-sensitive magnetic metal film made to be non-magnetic at the curier temperature, are allowed to flow in the non-magnetic material embedded in a pressing roller and having a low electric resistivity. An induction heating coil 42 is formed in such a manner that a temperature-sensitive magnetic metal film 40, the composition of which has been adjusted to have a predetermined curier temperature and the thickness of which is substantially the same as the skin depth, is wound around ferrite 41. The induction heating coil 42 is supplied with high-frequency electric currents so as to be induction-heated. The temperature-sensitive magnetic metal film 40 is slid under a guide plate 43 made of resin or ceramic so as to be rotated. Then, paper 44 on which toner powder is placed is heated and fixed while the paper 44 is held and pressed between the temperature-sensitive magnetic metal film 40 and the pressing roller 45. The pressing roller 45 is made of silicon rubber 46 having an elastic surface and arranged to serve as a heat insulation material. A non-magnetic material 47 having a low electric resistivity is embedded under the silicon rubber 46. The pressing roller having the above-mentioned structure is rotated about a shaft 48. As a result of the above-mentioned structure, the temperature-sensitive magnetic metal film 40 generates heat when the temperature is not higher than the curier temperature. When the temperature has exceeded the curier temperature, induction electric currents generated by the magnetic fluxes 49 allowed to pass through the temperature-sensitive magnetic metal film 40 brought to a non-magnetic state are allowed to flow in the non-magnetic material 47 embedded in the pressing roller and having the low electric resistivity. Thus, the heating value is reduced. As a result, a heating roller device having the self-temperature-controllability can be realized.

Although it is preferable that the non-magnetic material 47 having the low electric resistivity be aluminum or copper, a non-metal material, such as carbon, may be employed if the electric resistivity is low. The same material as the material for forming the shaft 48 may be employed so as to be integrally molded.

Eleventh Embodiment

Figure 14A:
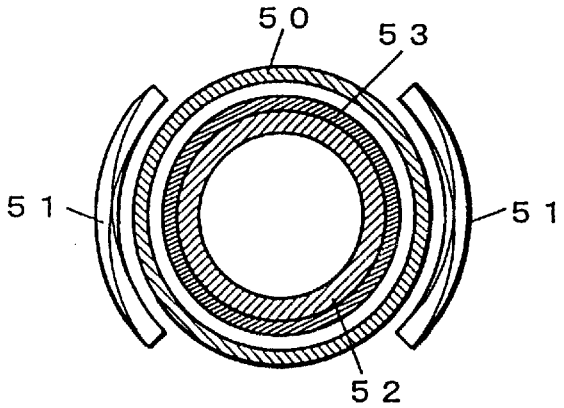
FIGS. 14A and 14B are cross sectional views showing a heating roller device according to an eleventh embodiment of the present invention.

FIG. 14A shows a structure in which a temperature-sensitive magnetic metal pipe 50 is heated from outside by an induction heating coil 51. Moreover, a non-magnetic material 52 having an electric resistivity lower than that of the temperature-sensitive magnetic metal is disposed under the temperature-sensitive magnetic metal pipe 50 in such a manner that a space is formed from the temperature-sensitive magnetic metal pipe 50. When a heat insulation material 53 is wound around the surface of the non-magnetic material 52, also air has the heat insulation effect. Thus, the thermal capacity can be reduced. Moreover, a structure can be formed in which the non-magnetic material 52 having the low electric resistivity and the heat insulation material 53 are secured to enable only the temperature-sensitive magnetic metal pipe 50 to be rotated.

Figure 14B:
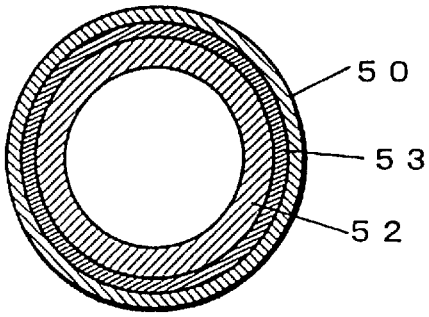

When the heat insulation material 53 is brought into contact with the temperature-sensitive magnetic metal pipe 50 as shown in FIG. 14B, a structure can be formed in which the non-magnetic material 52 having the low electric resistivity and the heat insulation material 53 reinforce the strength of the temperature-sensitive magnetic metal pipe 50.

Twelfth Embodiment

Figure 15:
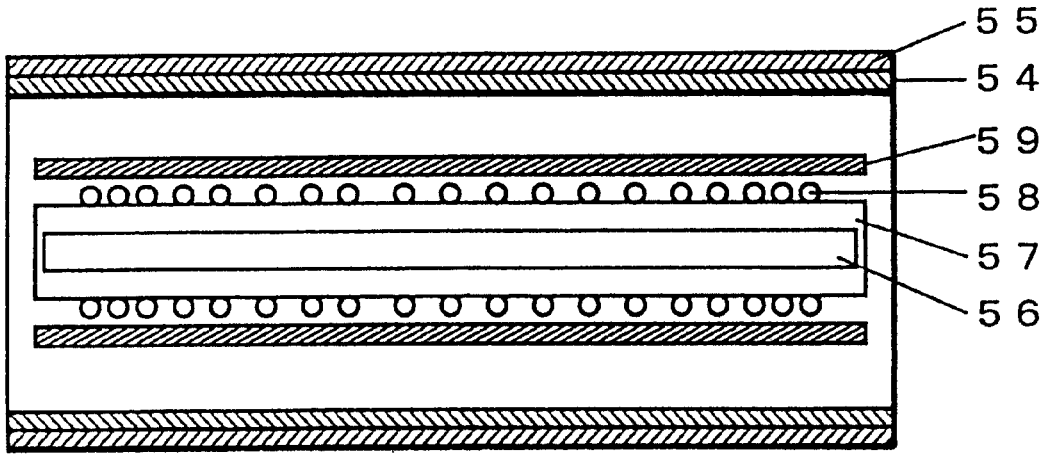
FIG. 15 is a cross sectional view showing a heating roller device according to a twelfth embodiment of the present invention.
Figure 16:
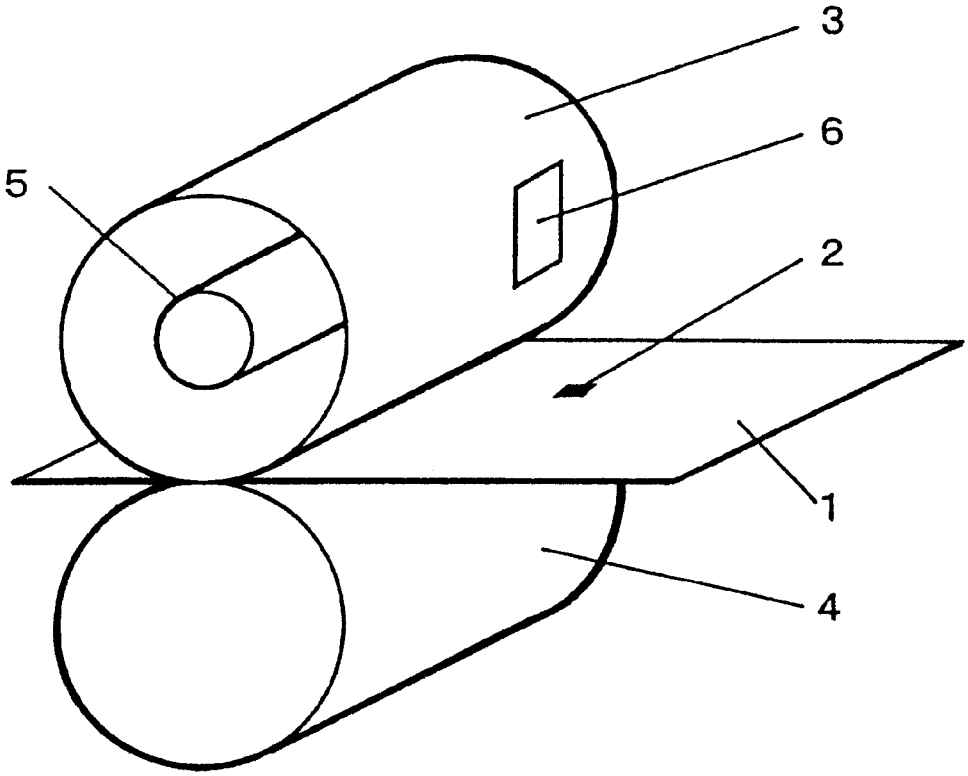
FIG. 16 is a perspective view showing the structure of a conventional heating roller device.
Figure 17:
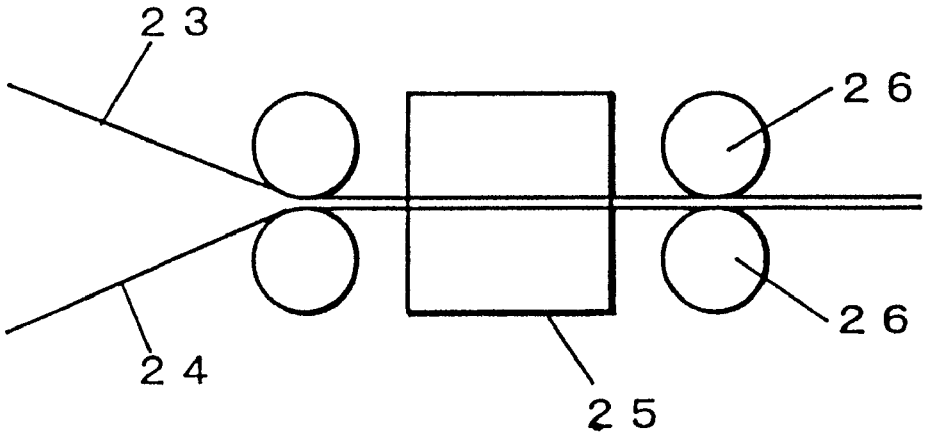
FIG. 17 is a diagram showing a method of joining temperature-sensitive magnetic metal and an aluminum plate to each other.

FIG. 15 is a cross sectional view showing a structure in which an induction heating coil is disposed in the inside portion. A roller is rotated which has a structure in which a pipe 55 made of a non-magnetic material having a low electric resistivity is laminated on the outside of a temperature-sensitive magnetic metal pipe 54. A bobbin 57 accommodating ferrite 56 is heated by an induction heating coil 58. It is preferable that the end portions are formed by densely winding a wire as compared with the central portion because the end portions have large thermal loads. Since the induction heating coil is secured to prevent rotation thereof, an electric insulation material 59 is disposed on the surface of the induction heating coil to prevent undesirable contact with the temperature-sensitive magnetic metal pipe. Thus, predetermined withstand voltage can be ensured. Moreover, even if electric discharge takes place from the metal roller to the induction heating coil because of applied static electricity or lightning surge, a high-frequency electric current generating circuit (not shown) is protected from being broken.

The first aspect of the invention has the structure comprising the metal roller having a curier temperature adjusted to an appropriate level and the induction heating section for induction-heating the metal roller. The thickness of the metal roller exceeds the skin depth. Thus, a heating roller device can be realized which is capable of using the self-temperature-controllability of the metal roller and having a simple structure.

The second aspect of the invention has the structure that the metal roller is composed of the alloy, which has a curier temperature adjusted to an appropriate level, and the non-magnetic metal material laminated on the alloy. Thus, a heating roller device can be realized which has a furthermore significant self-temperature-controllability and which exhibits a simple structure.

The third aspect of the invention has the structure that the metal roller is composed of the alloy, which has a curier temperature adjusted to an appropriate level, and the non-magnetic metal material placed in such a manner that a space is formed from the alloy. Thus, a heating roller device can be realized which has a small thermal capacity and which is permitted to be heated in a short time.

The fourth aspect of the invention has the structure that the induction heating coil forming the induction heating section is disposed on the inside of the metal roller. Thus, a heating roller device can be realized which can easily be magnetically shielded and which has further improved self-temperature-controllability.

The fifth aspect of the invention has the structure that the induction heating coil forming the induction heating section is disposed on the outside of the metal roller. Thus, a heating roller device can be realized which exhibits high speed at which the temperature is raised.

The sixth aspect of the invention has the structure that the induction heating coil forming the induction heating section is disposed at a position at which a target which must be heated and the metal roller are brought into contact with each other or a position immediately in front of the position of the contact. Thus, a heating roller device can be realized which does not use large electric power.

The seventh aspect of the invention has the structure that the induction heating coil forming the induction heating section is disposed at a position at which a target which must be heated and the metal roller are separated from each other. Thus, a heating roller device can be realized, the temperatures of which can be uniformed.

The eighth aspect of the invention has the structure composed of the pipe, which is made of the temperature-sensitive magnetic metal and the composition of which has been adjusted to have a predetermined curier temperature, and the metal pipe joined to the pipe which is made of the temperature-sensitive magnetic metal. Moreover, the metal pipe is made of the material having a resistivity lower than that of the temperature-sensitive magnetic metal and joined to the pipe made of the temperature-sensitive magnetic metal by a drawing work. Thus, the pipe made of the temperature-sensitive magnetic metal and the metal pipe can be joined to each other without formation of any gap. As a result, an induction heating pipe exhibiting excellent heating characteristic can be realized.

The ninth aspect of the invention has the structure incorporating the pipe, which is made of the temperature-sensitive magnetic metal and the composition of which has been adjusted to have a predetermined curier temperature, and the metal pipe joined to the pipe which is made of the temperature-sensitive magnetic metal. The metal pipe is made of the material having a resistivity lower than that of the temperature-sensitive magnetic metal and joined to the pipe made of the temperature-sensitive magnetic metal by press fitting so that an induction heating pipe is realized in which copper having the melting point which closes that of the pipe made of the temperature-sensitive magnetic metal is employed to form the metal pipe.

The tenth aspect of the invention has the structure incorporating the pipe, which is made of the temperature-sensitive magnetic metal and the composition of which has been adjusted to have a predetermined curier temperature, and the metal pipe joined to the pipe which is made of the temperature-sensitive magnetic metal. Moreover, the metal pipe made of the material having the resistivity lower than that of the temperature-sensitive magnetic metal is joined to the pipe made of the temperature-sensitive magnetic metal by brazing or soldering. Thus, an induction heating pipe can be realized which is suitable for low-volume manufacture and which can easily be manufactured when copper is employed to form the metal pipe.

The eleventh aspect of the invention has the structure incorporating the pipe, which is made of the temperature-sensitive magnetic metal and the composition of which has been adjusted to have a predetermined curier temperature, and the metal pipe joined to the pipe which is made of the temperature-sensitive magnetic metal. The metal pipe is made of the material having a resistivity lower than that of the temperature-sensitive magnetic metal. The pipe made of the temperature-sensitive magnetic metal is cast in the material of the metal pipe so that the pipe made of the temperature-sensitive magnetic metal and the metal pipe are joined to each other. Thus, an induction heating pipe suitable to form a complicated shape can be realized.

The twelfth aspect of the invention has the structure comprising the temperature-sensitive magnetic metal pipe or the temperature-sensitive magnetic metal film, the composition of which has been adjusted to have a predetermined curier temperature, and the non-magnetic material having an electric resistivity lower than that of the temperature-sensitive magnetic metal and disposed in such a manner that a space is formed from the non-magnetic material. Thus, significant self-temperature-controllability can be obtained and the thermal capacity can be reduced so that the temperature is raised in a short time.

The thirteenth aspect of the invention has the structure that the heat insulation material is disposed in the space so that the heat efficiency is improved.

The fourteenth aspect of the invention has the structure that the electrical insulation material is disposed on the surface of the induction heating coil so that the contact with the temperature-sensitive magnetic metal pipe or the temperature-sensitive magnetic metal film is prevented. Thus, the device can be protected from static elasticity and lightening surge.

The fifteenth aspect of the invention has the structure that the thickness of the temperature-sensitive magnetic metal pipe or the temperature-sensitive magnetic metal film is in a range from 50% to 200% of the skin depth. Thus, the most significant self-temperature-controllability can be realized.

What is claimed is:

1. A heating roller device for heating a target, said heating roller device comprising:

a rotatable metal roller having a side wall with an exterior surface for contacting said target, said side wall being composed of a metal with a curier temperature adjusted to an appropriate level an induction heating section for induction-heating said metal roller; and a power source for supplying electric current to said induction heating section, said current having a frequency that creates a skin depth in the side wall that is less than the thickness of the side wall.

2. A heating roller device for heating a target, said heating roller device comprising:

a rotatable metal roller having an exterior surface for contacting said target, said metal roller including a first layer made of an alloy, which has a curier temperature adjusted to an appropriate level, and a second layer made of a non-magnetic metal laminated on said first layer, said non-magnetic metal having a resistivity lower than said alloy; and an induction heating section for induction-heating said metal roller.

3. A heating roller device according to claim 2, wherein said second layer is laminated on said first layer so as to form a space between said first and second layers.

4. A heating roller device according to any one of claims 1 to 3, wherein an induction heating coil forming said induction heating section is disposed on the inside of said metal roller.

5. A heating roller device according to any one of claims 1 to 3, wherein an induction heating coil forming said induction heating section is disposed on the outside of said metal roller.

6. A heating roller device according to any one of claims 1 to 3, wherein an induction heating coil forming said induction heating section is disposed at a position where said target to be heated and said metal roller are brought into contact with each other or a position immediately in front of the position of the contact.

7. A heating roller device according to any one of claims 1 to 3, wherein an induction heating coil forming said induction heating section is disposed at a position where said target to be heated and said metal roller are separated from each other.

8. A heating roller device according to any one of claims 1 to 3, wherein an electrical insulation material is disposed on a surface of an induction heating coil forming said induction heating section.

9. A heating roller device according to claim 3, wherein a heat insulation material is disposed in said space.

10. A heating roller device according to claim 2, wherein said metal roller comprises:

a first pipe comprising said first layer, said first pipe being made of said alloy, which is a temperature-sensitive magnetic metal and the composition of which has been adjusted to have a predetermined curier temperature, and a second pipe comprising said second layer and being joined to said first pipe, said second pipe being made of said non-magnetic metal and being joined to said first pipe by a drawing operation.

11. A heating roller device according to claim 2, wherein said metal roller comprises:

a first pipe comprising said first layer, said first pipe being made of said alloy, which is a temperature-sensitive magnetic metal and the composition of which has been adjusted to have a predetermined curier temperature, and a second pipe comprising said second layer and being joined to said first pipe, said second pipe being made of said non-magnetic metal and being joined to said first pipe by press fitting.

12. A heating roller device according to claim 2, wherein said metal roller comprises:

a first pipe comprising said first layer, said first pipe being made of said alloy, which is a temperature-sensitive magnetic metal and the composition of which has been adjusted to have a predetermined curier temperature, and a second pipe comprising said second layer and being joined to said first pipe, said second pipe being made of said non-magnetic metal and being joined to said first pipe by brazing or soldering.

13. A heating roller device according to claim 2, wherein said metal roller comprises:

a first pipe comprising said first layer, said first pipe being made of said alloy, which is a temperature-sensitive magnetic metal and the composition of which has been adjusted to have a predetermined curier temperature, and a second pipe comprising said second layer and being joined to said first pipe, said second pipe being made of said non-magnetic metal and being joined to said first pipe by being cast over said first pipe.

14. A heating roller device according to claim 2, wherein the thickness of said alloy is in a range from 50% to 200% of a skin depth.

* * * * *